United States Patent [19]

Weber et al.

[11] 4,289,500

[45] Sep. 15, 1981

[54] METHOD OF PRODUCING HOT BRIQUETTES

[75] Inventors: Heinrich Weber, Recklinghausen; Horst Dungs, Herne; Karl-Heinz Wollenhaupt, Gelsenkirchen, all of Fed. Rep. of Germany; Yves Brasseur, Strassen; Henri Birscheidt, Lintgen, both of Luxembourg; Franz Beckmann, Alsdorf, Fed. Rep. of Germany

[73] Assignee: Firma Carl Still GmbH & Co. KG, Fed. Rep. of Germany

[21] Appl. No.: 142,150

[22] Filed: Apr. 21, 1980

[30] Foreign Application Priority Data

Apr. 21, 1979 [DE] Fed. Rep. of Germany ..... 2916260

[51] Int. Cl.[3] ..... C10L 5/16; C10L 5/02

[52] U.S. Cl. ..... 44/15 R; 44/10 E; 44/10 H

[58] Field of Search ..... 44/10 R, 10 C, 10 D, 44/10 H, 10 E, 15 R

[56] References Cited

U.S. PATENT DOCUMENTS

| | | | |
|---|---|---|---|
| 3,841,849 | 10/1974 | Beckmann | 44/10 H |
| 4,142,941 | 3/1979 | Weber et al. | 44/10 H |
| 4,181,502 | 1/1980 | Weber et al. | 44/10 C |
| 4,187,079 | 2/1980 | Weber et al. | 44/10 C |

*Primary Examiner*—Carl F. Dees
*Attorney, Agent, or Firm*—McGlew and Tuttle

[57] ABSTRACT

A method of producing hot briquettes in a plurality of stages comprises heating inert components which do not soften by direct heat exchange with hot carrier gases which are generated in a combustor to a temperature of about from 550° to 700° C. Thereafter the heated inert components and the gases are directed to a first separator to separate the carrier gases from the heated inert components. A caking bituminous binder coal component is then preheated and dried to temperatures of either 60° over or under 300° C. with the separated carrier gas. The binder coal and the separated carrier gas is then directed to a second separator to provide a second separated carrier gas and the heated binder coal. The second heated carrier gas is directed into a third separator in direct heat exchange with a second inert component which is then heated by this to a temperature of from 350° to 600° C. The second inert component is then separated from the second separator carrier gas and directed back for heat exchange with the hot carrier gases in the first separator, both the inert components which are separated and the binder coal are then directed into a mixer for premixing and then subsequently into a roll press for forming them into briquettes.

11 Claims, 1 Drawing Figure

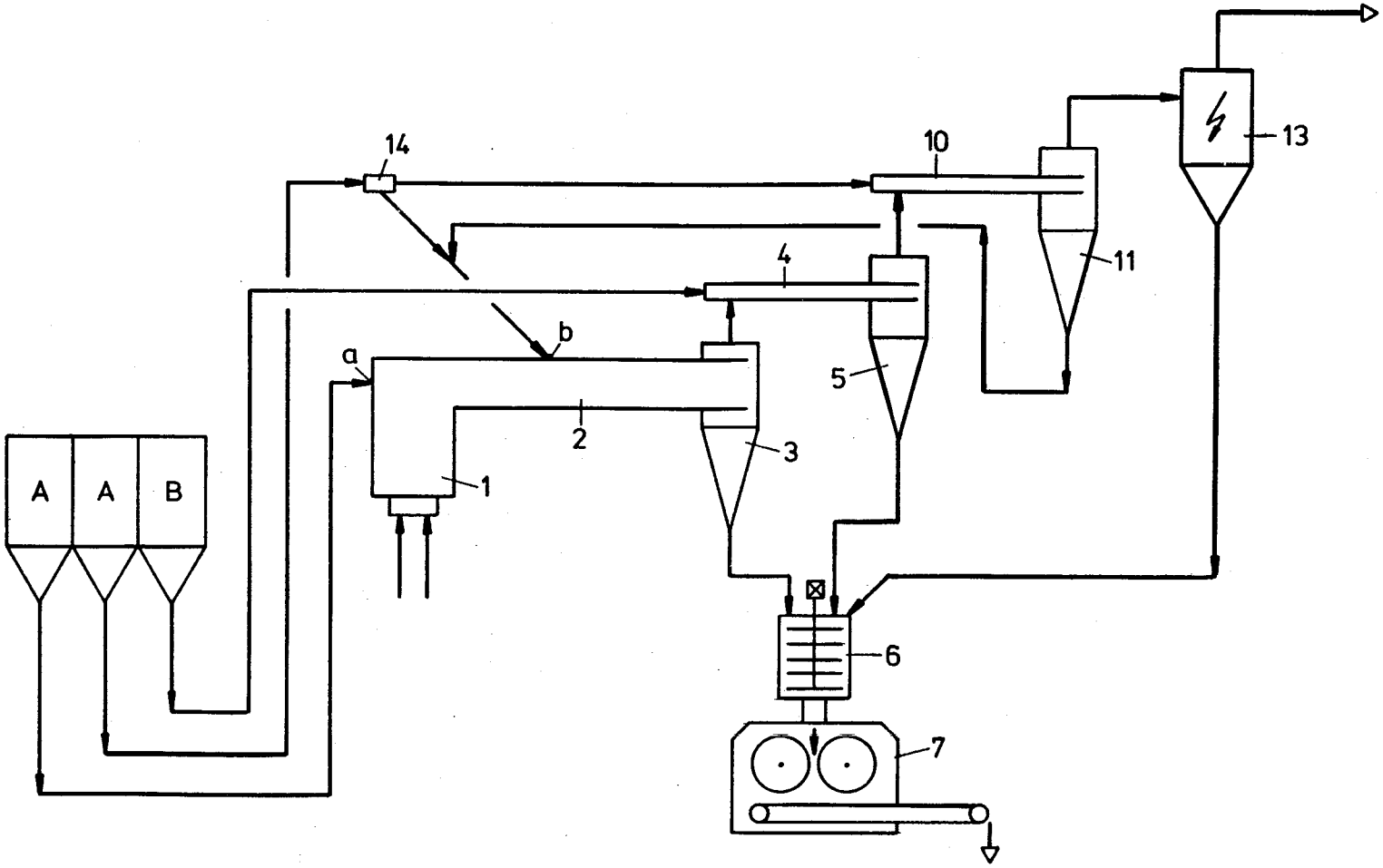
13
11
10
5
4
3
6
7
2
b
1
14
a
A
A
B

METHOD OF PRODUCING HOT BRIQUETTES

FIELD AND BACKGROUND OF THE INVENTION

This invention relates in general to the preparation of briquettes primarily for the metallurgical furnace use and in particular, to a new and useful method of producing hot briquettes in a plurality of heating stages.

In a prior art method, known as the ANCIT method and disclosed in West German patent 19 15 905, two flash reactors are series connected in the gas flow path, so that initially, in a first flash reactor and by means of the same gas stream which is used in the next stage, the pneumatically introduced inert component is heated up to about 600° C., and may be simultaneously degassed. After separating this component from the gas in a following cyclone, the same gas is directed into a second flash reactor where it is used to heat the, also pneumatically introduced, binder component to a temperature which is lower than that of the inert component at the outlet of the first cyclone. In methods of this kind, after a separation in a following cyclone, a lean gas of low calorific value and loaded with residual dust is obtained which still has a sensibly high temperature and is then cooled and purified in a wet scrubber to be further used.

With such a method, the sensible thermal energy absorbed by the water can hardly be further utilized. Also, the residual dust present in the gas is necessarily obtained in the form of mud requiring a troublesome further treatment.

To enlarge the coal basis for this method, there is known to use as the inert component poorly caking, more volatile coals after a special thermal treatment (see Stahl and Eisen 92,1972, No. 21, page 1041). The coal is subjected to this preliminary treatment in a short flash reactor and at relatively low temperatures. The coal is then separated from the waste gas in a cyclone, cooled with water and recycled to the coal charging bins. Consequently, after this advance treatment, the more volatile coal, having the temperature of the ambience, must again be heated up. This requies a great amount of additional energy to be supplied, and again residual dust is obtained in the form of mud.

In a modified method of this kind, a fluidized-bed drier may be substituted for the flash reactor.

According to another prior art method, known as the BFL hot briquetting method and described, for example, in the book "Rohstoff Kohle" published by Verlag Chemie Weinheim 1978, pages 276 to 277, coal carbonizing at low temperatures and binder coal are dried separately in a flash drier and the binder coal is comminuted to particles smaller than one millimeter. After drying, the low-temperature coal is heated up in a mixer with hot low-temperature coke (about 800° C.) and degassed. After degassing, the low-temperature coke is directed for further heating into an uptake and then, through a collecting bin, to the hot briquetting process proper, where it is pressed, together with the binder, to briquettes. So, in this method, the coal components are dried and heated separately, and a separate metering of gas and coal amounts is needed for each of the stages. Under elevated-temperature conditions, this is very expensive.

SUMMARY OF THE INVENTION

The invention is directed to a method which makes it possible to utilize the sensible thermal energy contained in the so-called lean gas and to obtain the residual dust entrained by the carrier gas in dry state, while maintaining the reliable and simple original way of metering the amounts.

In accordance with the method of the invention, hot briquettes are produced in a plurality of heating stages. In the first heating stage, coal components are heated with combustion gases which are generated in the temperature range of from 550° to 700° C. The heated coal components and gases are directed to a first separator to separate the carrier gases from the heated coal components. The caking bituminous binder coal is then directed into heat exchange with the separated gas in a temperature range of about 60° on either side of 300° C. and then they are directed into a second separator so that the carrier gas is separated a second time, this time from the bituminous binder coal. This second time separated carrier gas is then directed into heat exchange with another quantity of the coal component at a temperature in the range of from 350° to 600° C. and the component is directed back for heat exchange with the initial hot carrier gases in the first separator. Both the quantities of the coal components which are separated and the binder coal which is separated after heating are directed into a mixer and then into a roll press to form the product into briquettes.

In the above method, while using a flash reactor as the first heating stage, the predried part of the inert components is advantageously fed to a farther injection point, not to the first one. This is advisable particularly in instances where a coal having more than 6% of volatile matter is to be used. As is well known, especially in the first flash reactor, the coal is not only predried and heated, but also thermally comminuted. This communition is the more intense the more volatile matter the coal contains. The inventive predrying process reduces the effect of communition if the coal is fed to a farther injection point, thus introduced into an already somewhat cooled carrier gas. With coals having a higher content of volatile matter, such a reduced comminution generally contributes to the strength of the produced hot briquettes.

It is advantageous in the inventive method to control the heat exchange in the moist coal predrying process in such a way as to cool the obtained carrier gas to a temperature of less than 200° C., but not down to the dew point, and to remove the dust in a following dry filter, without wet scrubbing. From such a gas both a dry residual dust and an almost dust free and further usable lean gas can be obtained. Another advantage of the invention is that about 15 to 20% of the fuel is saved which would otherwise be needed for the operating heat in the hot briquetting process. This thermal energy has hitherto substantially been lost in the cooling water of the wet scrubber, or simply carried off as waste heat to the atmosphere. Since the entire amount of the component intended for predrying is fed into the first flash reactor, no additional metering in a hot state is necessary. In consequence, the individual components to be charged are metered only once and in a cool state so that a reliable and simple operation is ensured.

Accordingly, it is an object of the invention to provide an improved method of forming briquette coals in which a quantity of a coal component is heated first with combustion gases which are generated and this inert component is passed through a separator and directed to a mixer along with the binder coal which is heated by the separated gas in a second separator, the gas being further usable in a third separator to heat another quantity of the coal component and permit it to be directed back into the initial heat exchange with the hot carrier gases which are generated.

A further object of the invention is to provide a method of making briquettes which is simple to carry out and inexpensive to execute.

DESCRIPTION OF THE PREFERRED EMBODIMENTS

In the following the invention is explained, by way of example, with reference to the accompanying diagrammatical illustration of a plant for carrying out the method. The single FIGURE shows a combustion chamber 1 for producing the hot carrier gas which is directed from the combustion chamber into a flash reactor 2. A first quantity of moist coal components which do not soften by direct heat exchange with hot carrier gases, supplied from bins A, are injected or added to the hot carrier at different points a,b of the flash reactor 2 for direct heating to a temperature of about 550° to 700° C. and separated from the carrier gas in a following cyclone 3. Then, a caking bituminous binder coal from bin B is introduced into a flash reactor 4 through which the heating gas from the first stage, already cooled down to 800°±100° C., is directed. There, the caking bituminous binder coal is heated to a temperature range from 250° to 360° C. The binder coal, separated from the carrier gas in a cyclone 5, is then intimately mixed with the heated coal components in a mixer 6 and fed to a roll press 7. The subsequent hardening and cooling of the briquettes is effected in a way described in German application No. P 2842425, for example. The temperature of the charged coal in the mixer is 430° to 550° C. The carrier gas flowing out of the flash reactor 4 or the following cyclone 5 is directed into a flash drier 10 a second quantity of the moist coil components, where it is heated up and predried, and the coal components are separated from the carrier gas again in a following cyclone 11. Due to the intimate mixing of the moist coal component with the hot carrier gas, having a temperature of 350° to 600° C., preferably 470°±60° C. and coming from the second flash reactor, the second quantities of coal components is predried, while the flue gases are cooled below 200° C. The coal component obtained in cyclone 11 is continuously removed and fed to the injection point b of the flash reactor 2, which is located downstream of injection point a.

If air is used as the conveying fluid, it is supplied in controlled amounts, to limit the burning loss in flash reactor 2 to a desired minimum. The carrier gas obtained in the last cyclone 11 and having a temperature of less than 200° C. but above its dew point is separated from residual dust particles in an electrostatic precipitator 13 and directed to further use.

In many cases it may be advisable to recycle a part of this carrier gas having passed through precipitator 13 into combustion chamber 1 and use it for controlling the temperature in first flash reactor 2.

Initially, at the start of the operation of the plant, the moist inert component, which later will be preheated and predried in flash reactor 10, is blown into flash reactor 2 at the injection point b. After attaining constant operating conditions, a pipe switch 14 is actuated and the moist inert component is then directed into the third flash reactor 10.

What is claimed is:

1. A method of producing hot briquettes in a plurality of heating states, comprising heating a first quantity of coal components which do not soften by direct heat exchange with hot carrier gases to a temperature of about from 550° to 700° C., directing the heated coal components and gases into a first separator to separate the carrier gases from the heated first quantity of coal components, for subsequent use, preheating and drying a caking bituminous binder coal component with the separated carrier gas to a temperature ranging from 240° to 360° C., directing the heated binder coal component and the separated carrier gas to a second operator to provide a second separated carrier gas and heated and dried binder coal, directing the second separated carrier gas into direct heat exchange with a second quantity of said coal components at a temperature in the range of from 350° to 600° C., then directing the heated and predried second quantity of said coal components and the second separated carrier gas to a third separator to separate the second quantity of coal components from the second separated carrier gas, directing the separated second quantity of said coal components into heat exchange with the hot carrier gases in said first mentioned heating step, directing the separated first and second quantities of coal components of the first and third separators and the separated binder from the second separator into a mixer, mixing the separated binder and first and second quantities of coal components, and then directing the mixture into a roll press to form briquettes.

2. A method according to claim 1, wherein a flash reactor is used in the direct heat exchange of the carrier gases with the coal components and wherein said heated and predried second quantity of coal components is injected into the flash reactor at a location downstream of the first quantity of said coal components.

3. A method according to claim 1, including cooling the second separated carrier gas to a temperature of less than 200° C. without bringing it down to its dew point and directing the freed carrier gas into a dry filter to free it from dust and without web scrubbing thereof.

4. In a method of producing hot briquettes in a plurality of heating states of the type having the steps including, in a first heating stage, injecting a quantity of coal components, which do not soften by direct heat exchange, into a hot carrier gas to directly heat the coal components to a temperature ranging from 550° to 700° C., separating the heated coal components from the carrier gas, and then, in a second heating stage, preheating and drying a caking bituminous binder coal to a temperature ranging from 240° to 360° C. by directly heating said binder coal with said separated carrier gas, the improvement comprising the steps of reseparating the carrier gas from the heated binder coal, directly heating and predrying a second quantity of said coal components with said reseparated carrier gas, separating said heated second quantity of coal components from said reseparated carrier gas, and injecting said heated second quantity of coal components into said carrier gas in the first heating stage.

5. The improved method, as set forth in claim 4, wherein the steps of injecting said coal components into the said carrier gas in the first heating stage comprises injecting into said carrier gas at a first point and a second point located downstream of said first point, and wherein said first quantity of coal components is injected at said first point and said heated second quantity of coal components is injected at said second point.

6. The improved method as set forth in claim 5, wherein the step of directly heating and predrying said second quantity of said coal components comprises cooling said separated carrier gas to a temperature below 200° C. and above the dew point of said reseparated carrier gas.

7. The improved method as set forth in claim 6, further comprising the step of subjecting said cooled reseparated carrier gas to electrostatic precipitation to recover residual dust particles.

8. The improved method as set forth in claim 7, further comprising mixing the residual dust particles, the heated coal components and the heated binder coal, and pressing said mixture to form briquettes.

9. The improved method as set forth in claim 4, wherein the step of directly heating and predrying said second quantity of said coal components comprises cooling said separated carrier gas to a temperature below 200° C. and above the dew point of said reseparated carrier gas.

10. The improved method as set forth in claim 9, further comprising the step of subjecting said cooled reseparated carrier gas to electrostatic precipitation to recover residual dust particles.

11. The improved method as set forth in claim 10, further comprising mixing the residual dust particles, the heated coal components and the heated binder coal, and pressing said mixture to form briquettes.

* * * * *